US005893177A

United States Patent [19]

Roemen et al.

[11] Patent Number: 5,893,177

[45] Date of Patent: Apr. 13, 1999

[54] PERSONAL HYGIENIC DEVICE

[76] Inventors: Arlen M. Roemen, 325 Dellwood Dr., Eugene, Oreg. 97405; William F. Glenn, 2577 Elysium, Eugene, Oreg. 97401

[21] Appl. No.: 08/895,934

[22] Filed: Jul. 17, 1997

Related U.S. Application Data

[63] Continuation-in-part of application No. 08/513,459, Aug. 10, 1995, Pat. No. 5,666,676.

[51] Int. Cl.[6] ..... A47K 3/22

[52] U.S. Cl. ..... 4/443; 4/448

[58] Field of Search ..... 4/420.2, 443, 448, 4/567

[56] References Cited

U.S. PATENT DOCUMENTS

| | | | |
|---|---|---|---|
| 2,241,823 | 5/1941 | McFarland et al. | 4/448 X |
| 3,210,141 | 10/1965 | Thomas | 312/209 |
| 3,281,195 | 10/1966 | Shownes | 312/209 |
| 3,874,506 | 4/1975 | Hill et al. | 206/229 |
| 3,938,741 | 2/1976 | Allison | 239/75 |
| 4,053,193 | 10/1977 | Grover et al. | 312/209 |
| 4,189,195 | 2/1980 | Turney et al. | 312/209 |
| 5,090,067 | 2/1992 | Cogdill | 4/420.2 |
| 5,160,197 | 11/1992 | Klose | 4/605 X |
| 5,666,676 | 9/1997 | Roemen et al. | 4/443 |

FOREIGN PATENT DOCUMENTS

| | | | |
|---|---|---|---|
| 197812 | 12/1978 | United Kingdom | 4/448 |

*Primary Examiner*—Robert M. Fetsuga

*Attorney, Agent, or Firm*—Kolisch, Hartwell, Dickinson, McCormack & Heuser

[57] ABSTRACT

A cabinet in a bathroom wall is mounted for use by a user sitting on a toilet. A mixing valve in the cabinet receives a flow of water from hot and cold water inlets and provides flow regulation and control. A flexible conduit is coupled to the valve and is provided with a hand grip removably held in place in the cabinet so as to position a nozzle of the hand grip for discharge of the flow of water into a drain opening. A temperature indicator is served by a sensor responsive to the temperature of the flow of water and provides a readout to the user. Testing of the water temperature may also be achieved by touch.

22 Claims, 1 Drawing Sheet

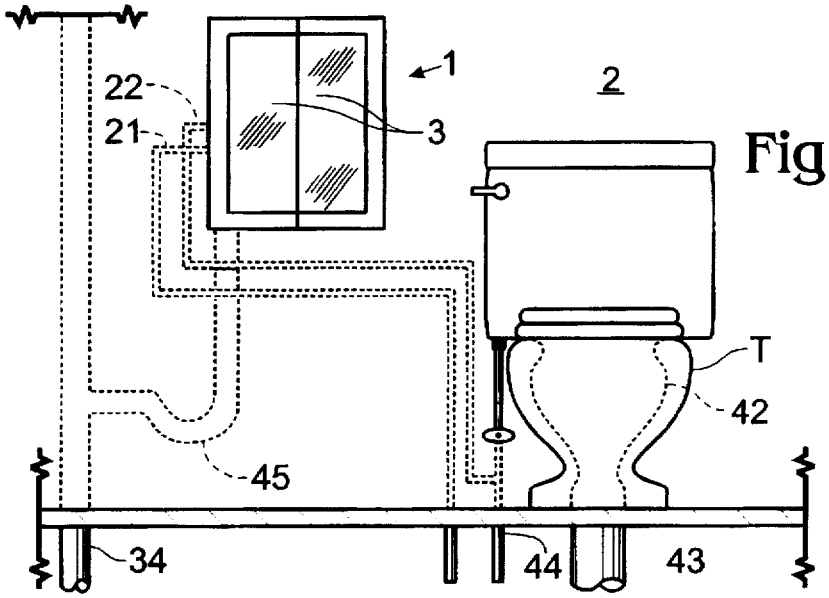
Fig. 1
Fig. 2
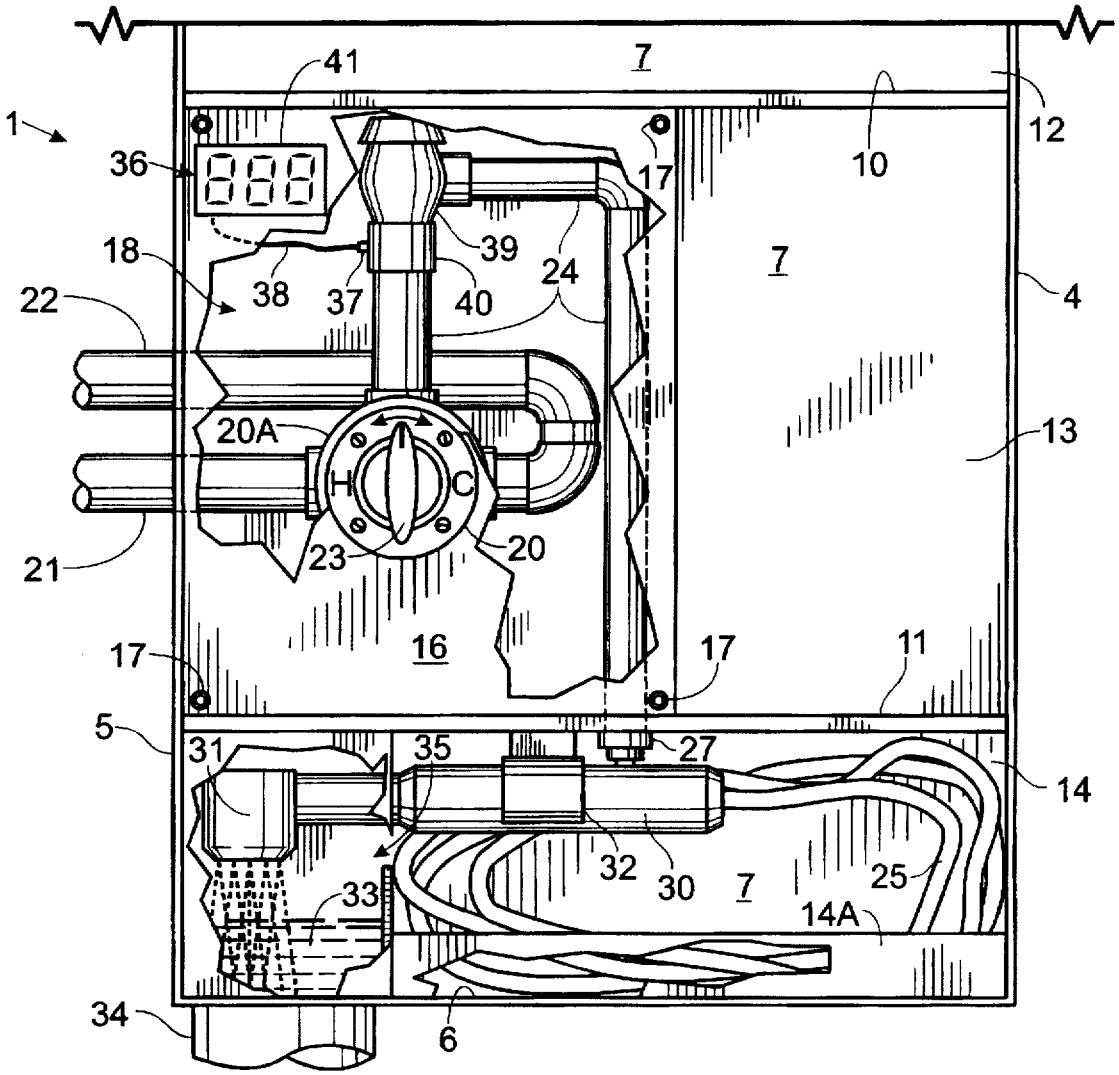

PERSONAL HYGIENIC DEVICE

RELATED APPLICATION

This application is a continuation-in-part application of our application, Ser. No. 08/513,459, which was filed on Aug. 10, 1995, U.S. Pat. No. 5,666,676.

BACKGROUND OF THE INVENTION

The present invention pertains generally to systems, fixtures, etc., for use in a bathroom for personal hygiene.

Fixtures currently utilized in bathrooms include bidets which are quite costly particularly from the plumbing effort incurred. Additionally, most bathrooms, especially in older homes, lack the space for installation of a bidet.

Existing portable items for personal hygiene are difficult to store in a compact, tidy manner. Attempts to overcome such problems are found in U.S. Pat. Nos. 3,210,141 and 3,281,195 while U.S. Pat. No. 4,189,195 is directed toward the storage of personal hygiene items. The known prior art teaches the provision of wall mounted cabinets with receptacles and drain openings filled from a remote source or by a faucet plumbed into a cabinet wall to provide hot and cold water sources but with no means being provided to ensure a flow rate and temperature control.

SUMMARY OF THE PRESENT INVENTION

The present invention is preferably embodied in a bathroom cabinet having components providing a controlled water flow to a conduit with a spray nozzle.

The cabinet is preferably inset in a bathroom wall adjacent a toilet to facilitate convenient adjustment of the control means provided. A water temperature display is provided. A hose with an outlet is housed in the cabinet to allow water temperature to stabilize at the desired temperature before use of the device. A pressure balanced mixing valve prevents sudden temperature changes while a thermometer or other suitable temperature sensor indicates a temperature at a current valve setting which may be unaffected by on-off positioning of the valve control.

Important objectives of the present invention include the provision of a cabinet which houses a flexible conduit that is fitted with a nozzle and which may be stowed in a position in a cabinet so as to direct a discharge flow from the nozzle into a receptacle in the housing until a desired water temperature has been reached; the provision of a cabinet with a temperature sensor to measure and provide the user with a readout of current temperature of a mixed hot and cold water flow; the provision of a bathroom cabinet for hygienic uses having a pressure balanced mixing valve to avoid sudden temperature changes in the water flow.

BRIEF DESCRIPTION OF THE DRAWINGS

In the accompanying drawings:

FIG. 1 is an elevational view of the present cabinet installed in a bathroom wall;

FIG. 2 is a fragmentary elevational view of the cabinet removed from the wall and with the doors detached.

DETAILED DESCRIPTION OF THE PREFERRED EMBODIMENTS

With continuing attention to the drawings, wherein applied reference numerals indicate parts similarly hereinafter identified, the reference numeral 1 in FIG. 1 indicates generally the present cabinet in place in a bathroom wall 2 in the general proximity of a toilet, which is generally indicated at T.

Cabinet 1 includes a closure 3 which may be a pair of doors. With attention to FIG. 2, the cabinet comprises sidewalls 4 and 5, a bottom wall at 6 and a top wall (not shown). A rear wall is at 7 contiguous with the above mentioned walls. Shelves at 10 and 11 along the top and bottom walls define storage areas at 12, 13 and 14. The number and shape of storage areas and their sizes may be varied to best suit current needs. A panel 16 is affixed to the frontal portion of the cabinet by fasteners 17 and provides a closure for an area 18, which receives the following described components. Hot and cold water inlets at 21 and 22 terminate in connection with a valve 20, and as such are configured to deliver a flow of water, and preferably a mixed flow of hot and cold water, to valve 20.

In FIG. 2, a valve controller or handle 23 is shown located immediately forward of panel 16, and valve 20 is mounted on cabinet rear wall 7 by a mounting flange at 20A. Valve 20 is preferably a mixing valve of the pressure balanced type as heretofore commonly used as a shower valve and maintains a constant outlet temperature regardless of pressure changes in the hot and cold inlets 21 and 22. Additionally, an off-on function of the valve 20 is controlled by inwardly and outwardly directed forces manually applied to handle 23. Valves of the above-described type are well known in the plumbing trade and accordingly no further description of same is believed necessary. It should be understood that it is meant to be within the scope of the present invention that other conventional valves may be used, such as a valve in which each inlet has a separate controller or handle. Although either of the previously described controller are preferred, however, because the flow of water may be stopped and started without altering the valve's temperature setting, namely, the distribution of hot and cold water in the resulting flow of water. This advantage may be met with dual controller valves if the valve includes a third component that enables the user to at least temporarily stop the flow of water out of the subsequently described nozzle 31.

An outlet conduit 24 is connected to (communicates with) valve 20. Conduit 24 is configured to receive a flow of water from valve 20 and includes a hose 25 extending from a coupling 27. Hose 25 is flexible to the extent it may be shaped in a serpentine manner for compact storage in cabinet 1 in a defined area, such as area 14 shown in FIG. 2. A lip 14A confines the hose in the area. A user-grippable region or hand grip 30 on hose 25 includes a nozzle 31 and is preferably of L-shape and facilitates removal and storage of hose 25. Outlet conduit 24 may be equipped with a vacuum breaker as commonly required by most plumbing codes. The vacuum breaker is indicated at 39 and prevents any back-siphonage in hose 25.

Hand grip 30 is removably positioned in a holder 32, which may be a flexible clip affixed in place on shelf 11, to facilitate convenient reception and removal of hand grip 30. Holder 32 preferably also serves to locate nozzle 31 for fluid discharge into a drain opening 33 which may be located subjacent the nozzle in a fluid discharge chamber 35. Accordingly, with hand grip 30 in place in holder 32 and upon opening of valve 20, a water flow may be directed into chamber 35, and subsequently into drain opening 33, which is in communication with a drain pipe 34 that discharges into a sanitary sewer line via a P-trap (not shown). Alternatively, a preliminary water flow may be otherwise discharged into a wash basin, toilet, etc., to permit dispensing with the drain opening, however this is not preferred because it requires the user to hold at all times or otherwise manually position the conduit, and especially the nozzle, to direct the flow of water.

Holder 32 may alternatively be coupled elsewhere on the cabinet or on fluid discharge chamber 35, as long as the holder is configured to removably receive hand grip 30, nozzle 31 or another suitable portion on conduit 24 to position nozzle 31 so that the flow of water discharged from the nozzle is directed into discharge chamber 35 or directly into drain opening 33.

A temperature indicator 36, such as a thermometer or other suitable device for measuring and displaying fluid temperature, measures the temperature of the flow of water in conduit 24 and includes a display 41 that conveys the temperature to the user. As shown, display 41 is a digital display and is supported by a panel 16. Indicator 36 includes a temperature sensor 37 that measures the temperature of the water in conduit 24 and transmits this reading to display 41 by a cable 38.

As shown, sensor 37 is received within a fitting 40 in place on conduit 24. It should be understood that sensor 37 may be positioned in a variety of positions along conduit 24 or on valve 20. Measuring the temperature of the water flow within conduit 24 is preferred, however, because it provides a more accurate reading when mixed flows of hot and cold water are combined in valve 20 because the flows will already be mixed and the resulting flow should be at a fairly uniform temperature.

While display 41 is shown in FIG. 2 as being a digital display, it should be understood that display 41 may be of any suitable form of digital, analog or graphical display or device for indicating the temperature of the flow of water to the user. In addition, indicator 36 may provide its own power source, such as a 1.5 volt battery, or alternatively, it may include a sensor and display that do not require a battery or other power source to measure and display the water temperature.

Referring briefly back to FIG. 1, one can see that the invented personal hygiene device, as shown housed in cabinet 1, is mounted in the general proximity of toilet T. As shown, toilet T includes a bowl 42 connected to a drain opening 43, which is different than the drain opening 33 into which nozzle 31 discharges water when conduit 24 is engaged by holder 32. Toilet T receives a flow of cold water from a cold water inlet 44, which is different from the invented personal hygiene device's cold water inlet 22, shown in FIG. 2. It should be understood that while drain openings or drains 33 and 43, as well as cold water inlets 22 and 44, may initially stem from the same source, such as a household's main water supply line, or may ultimately unite, such as in the household's sewer line, the openings and inlets are separate and distinct with respect to toilet T and the invented personal hygiene device. The device does not receive its water supply directly from toilet T, and the device's drain does not feed directly into toilet T. Similarly, toilet T does not receive its water supply directly from the invented personal hygienic device, and the toilet's drain does not feed directly into the device.

As discussed, the invented personal hygiene device should be mounted in the general proximity of toilet T. By this it is meant that they should be mounted so that a user sitting in a normal or reverse position on toilet T can reach valve 20 and grip 30 without having to get off of or rise from toilet T. The user should be able to reach grip 30 when conduit 24 is engaged by holder 32 and positioned to dispense water into the first drain opening 33 and/or chamber 35, hereinafter referred to as the conduit's stored position. Similarly, from the user's position on toilet T, the user should also be able to reach and control handle 23, which controls valve 20 and thereby controls the distribution and flow of hot and cold water to nozzle 31. Although shown in FIG. 2 as being generally adjacent valve 20, handle or valve controller 23 may be mounted in any suitable location for operative use by the user. For example, handle or valve controller 23 may be mounted apart from chamber 35, drain opening 33 and holder 32, such as on an adjacent wall or in a position other than within cabinet 1. Similarly, display 41 may also be mounted in a spaced relationship to cabinet 1 and the parts contained therein.

In operation, with hand grip 30 in place within holder 32 and upon opening of valve 20, a flow of water from at least one of, and preferably both of, inlets 21 and 22 will pass through conduit 24, including hose 25 and ultimately nozzle 31 for discharge into drain opening 33 and drain pipe 34 or directly into another receptacle, as discussed above. Indicator 36 will measure and display the temperature of the flow of water passing through conduit 24 and which may be controlled upon rotational positioning of valve control 23. Alternatively, water temperature may be manually tested by the user placing a finger in chamber 35, via an opening in the chamber, to touch the water discharged by nozzle 31.

Subsequent to a desired temperature being attained, valve control 23 is pushed inwardly to close the valve, thereby at least temporarily interrupting the flow of water from nozzle 31 and permitting removal of hand grip 30 from holder 32 and from the cabinet for operative positioning of nozzle 31 by the user on toilet T without discharging water as the handle is removed and positioned. After grasping grip 30 or another suitable portion of conduit 24, the user removes grip 30 from holder 32 and cabinet 1 and positions nozzle 31 generally within or adjacent the toilet's bowl 42 for providing the cleansing flow of water to the user at the desired temperature and flow rate. It should be understood that for conduit 24 to be positioned in this second or "in use" position, conduit 24 must be of sufficient length to extend from where it is coupled to valve 20 to the toilet's bowl. After positioning conduit 24, and especially nozzle 31, the user restarts the flow of water out of nozzle 31, such as by the outward displacement of controller 23 shown in FIG. 2, to provide the necessary cleansing function, whereafter the dispensed water is collected in bowl 42 and subsequently passes through the toilet's drain opening 43. After the cleansing process is completed, valve 20 is closed and hand grip 30 is reinstalled in holder 32, with any water discharged thereafter draining into drain pipe 34.

While we have shown but one embodiment of the invention, it will be apparent to those skilled in the that the invention may be embodied still otherwise without departing from the spirit and scope of the invention.

Having thus described the invention, what is desired to be secured by Letters Patent is:

We claim:

1. In combination, a bathroom cabinet, a mixing valve for communication with hot and cold water inlets, the valve configured to regulate and receive a flow of water from at least one of the hot and the cold water inlets;

an outlet conduit in communication with the valve for receiving the flow of water from the valve, the conduit including a hose normally housed in the cabinet and having a hand grip and a nozzle;

a fluid discharge chamber in the cabinet configured to receive the flow of water discharged from the nozzle, having a drain for conveying the flow of water from the chamber and including an opening configured to enable a user to manually test the temperature of the discharged flow of water in the discharge chamber; and a holder coupled to the cabinet for reception of the hand grip and positioning the nozzle for discharge of the flow of water into the chamber and permitting removal of the hand grip and the nozzle from the cabinet, wherein the holder is adapted to position the outlet conduit for discharge of the flow of water from the nozzle into the discharge chamber while further enabling the user to manually test the temperature of the discharged flow of water in the discharge chamber.

2. The combination of claim 1, wherein the temperature indicator includes a display for indicating the temperature of the flow of water in the outlet conduit.

3. The combination of claim 2, wherein the display is mounted on the cabinet.

4. The combination of claim 2, wherein the display is mounted adjacent the cabinet.

5. The combination of claim 1, wherein the mixing valve is a pressure balanced valve.

6. The combination of claim 1, wherein the conduit is selectively positionable between a first position in which it is at least substantially housed within the cabinet and the nozzle is positioned to discharge the flow of water into the chamber, and a second position in which the nozzle is removed from the cabinet and configured to deliver the flow of water to a user positioned on a toilet.

7. A personal hygienic device comprising:

a mixing valve for communication with a hot water inlet and a cold water inlet, the valve configured to regulate and receive a flow of water from at least one of the hot water and the cold water inlets;

an outlet conduit in communication with the valve for receiving the flow of water from the valve, the conduit including a hose having a hand grip and a nozzle;

a fluid discharge chamber configured to receive the flow of water discharged from the nozzle and having a drain for conveying the flow of water from the chamber; and a holder for removably receiving the hand grip and positioning the nozzle for discharge of the flow of water into the chamber, wherein the holder is adapted to maintain the position of the nozzle under a force imparted when the flow of water is discharged from the nozzle into the discharge chamber.

8. The device of claim 7, further comprising a temperature indicator configured to be responsive to and measure the temperature of the flow of water in the outlet conduit.

9. The device of claim 8, wherein the indicator has a display for indicating the temperature of the flow of water.

10. The device of claim 7, wherein the chamber includes an opening configured to enable the user to manually test the temperature of the discharged water prior to the water entering the second drain, and wherein the holder is adapted to position the nozzle for discharge of the flow of water into the discharge chamber while enabling a user to manually test the temperature of the flow of water discharged by the nozzle.

11. The device of claim 7, further including a storage area into which the conduit is received when it is engaged by the holder.

12. The device of claim 11, wherein the holder is coupled to the storage area.

13. The device of claim 11, wherein the holder is coupled to the chamber.

14. The device of claim 8, wherein the indicator is in communication with the valve and measures the temperature of water within the valve.

15. The combination of claim 1, further including a temperature indicator adapted to measure the temperature of the flow of water.

16. The device of claim 8, wherein the hand grip includes a region facing generally away from the nozzle, and the holder is adapted to engage the region of the hand grip with sufficient force to maintain the position of the hand grip and nozzle while the flow of water is dispensed from the nozzle.

17. A personal hygienic device, comprising:

a bathroom cabinet;

a mixing valve for communication with hot and cold water inlets, the valve configured to regulate and receive a flow of water from at least one of the hot and the cold water inlets;

an outlet conduit in communication with the valve for directly receiving the entire flow of water from the valve, the conduit including a hose normally housed in the cabinet, and the hose including a hand grip and a nozzle adapted to deliver the entire flow of water received by the outlet conduit;

a temperature indicator adapted to measure the temperature of the flow of water and display the temperature to a user;

a fluid discharge chamber within the cabinet and configured to receive the flow of water discharged from the nozzle and having a drain for conveying the flow of water from the chamber; and a holder mounted on the cabinet and adapted to selectively receive the hand grip and position the nozzle for discharge of the flow of water into the chamber.

18. The device of claim 17, wherein the mixing valve is housed within the cabinet.

19. The device of claim 17, wherein the holder selectively positions the hand grip to direct discharge of the flow of water from the nozzle into the discharge chamber while also enabling a user to manually test the temperature of the flow of water within the discharge chamber.

20. The device of claim 17, wherein the holder is adapted to engage the hand grip with sufficient force to maintain the position of the hand grip and nozzle while the flow of water is being discharged from the nozzle into the discharge chamber.

21. The device of claim 17, wherein the temperature indicator includes a display mounted on the cabinet.

22. The device of claim 17, wherein the hose is selectively positionable between a first position in which it is at least substantially housed within the cabinet and the nozzle is positioned to discharge the flow of water into the chamber, and a second position in which the nozzle is removed from the cabinet and configured to deliver the flow of water for discharge into a bowl of a toilet.

* * * * *